United States Patent [19]

Close

[11] Patent Number: 4,554,753

[45] Date of Patent: Nov. 26, 1985

[54] THIN-PROFILE COPY HOLDER

[76] Inventor: J. Garth Close, P.O. Box 168-6 SH, Malakoff, Tex. 75148

[21] Appl. No.: 530,194

[22] Filed: Sep. 9, 1983

[51] Int. Cl.[4] ..... B41J 11/38

[52] U.S. Cl. ..... 40/341; 40/342; 40/348; 40/361

[58] Field of Search ..... 40/341, 342, 343, 348, 40/349, 361

[56] References Cited

U.S. PATENT DOCUMENTS

| | | | |
|---|---|---|---|
| 339,770 | 4/1886 | Hayward | 40/348 |
| 1,172,943 | 2/1916 | Collins | 40/342 |
| 1,265,396 | 5/1918 | Sherwood | 40/348 |
| 2,006,714 | 7/1935 | Kunc | 40/342 |
| 2,102,431 | 12/1937 | McNamara | 40/341 |

FOREIGN PATENT DOCUMENTS

| | | | |
|---|---|---|---|
| 57172 | 8/1945 | Netherlands | 40/ |

*Primary Examiner*—Gene Mancene
*Assistant Examiner*—Wenceslao J. Contreras
*Attorney, Agent, or Firm*—Charles W. McHugh

[57] ABSTRACT

A copy holder adapted to foster the efficient comparison of two sets of data, one of which is visible on a display associated with a computer, and the other being visible on a sheet of flexible material, e.g., a sheet of paper. The comparison is fostered by reducing the necessary eye travel as an operator switches his attention back and forth between the data on the flexible sheet and the data on the display. A structural housing having a thin profile supports the display device in front of a computer operator, such that an operator may still see the data that appears on the display screen. The housing has a frontal opening through which the sheet of flexible material may be manipulated by the operator; and it has a rear opening through which a surplus quantity of the flexible sheet may be pushed. A support member is provided for supporting the sheet of flexible material so that it is folded into a generally U-shape, and a frontal section of the support member holds the flexible sheet so as to expose to view a transverse portion of the flexible sheet at a location that is vertically adjacent the display—and preferably immediately below the display. After data on a given transverse portion of the sheet has been utilized, the sheet is moved to present a fresh segment for examination.

14 Claims, 7 Drawing Figures

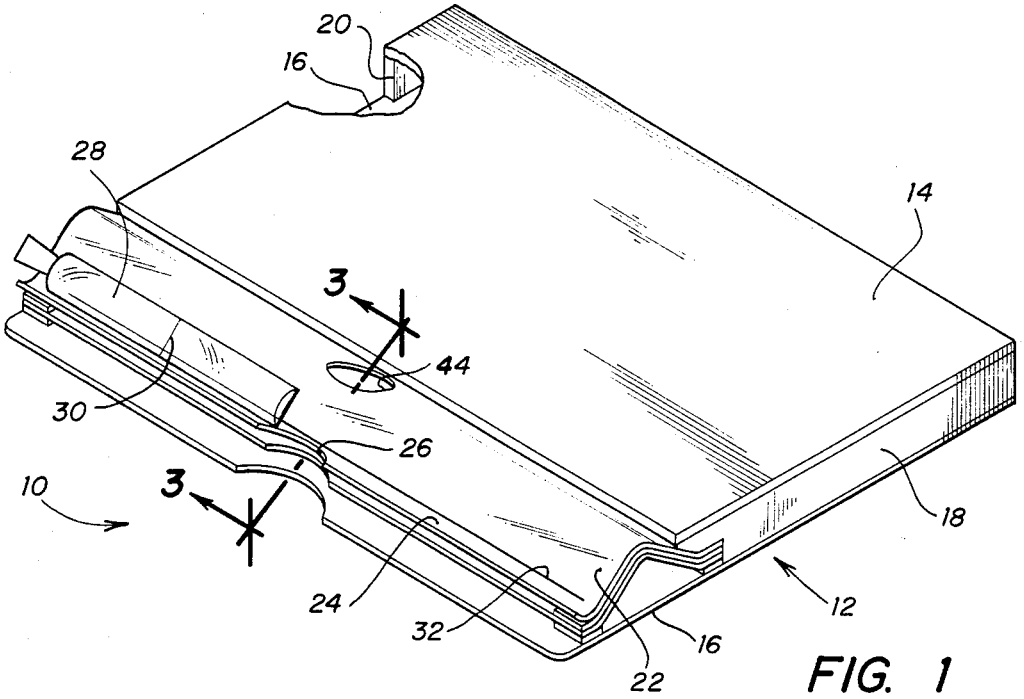
FIG. 1
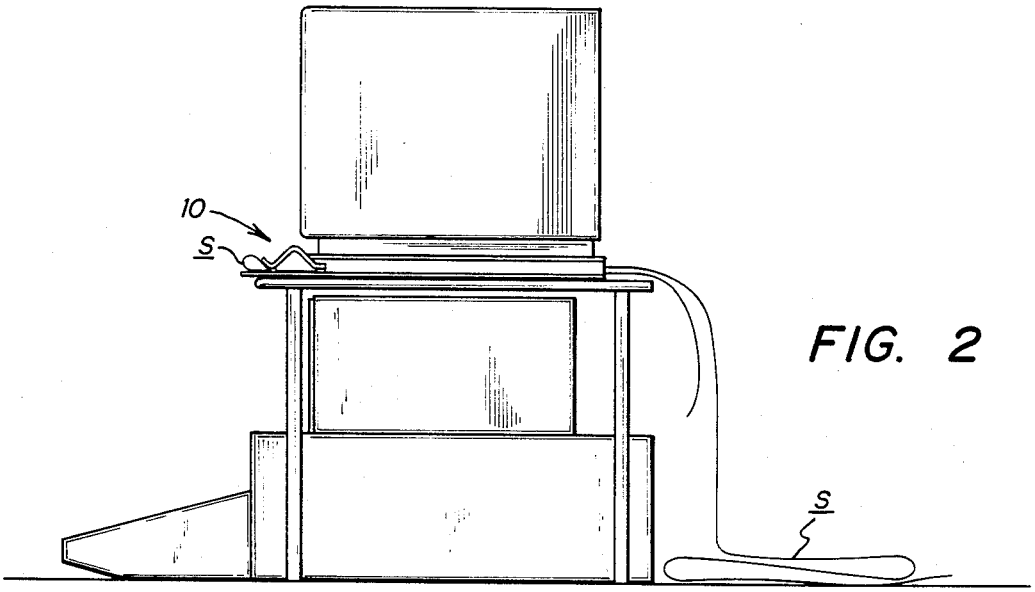
FIG. 2
FIG. 3
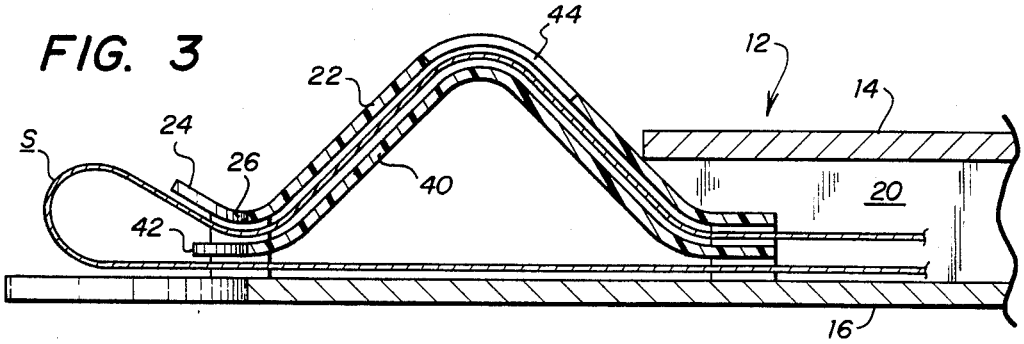

THIN-PROFILE COPY HOLDER

BACKGROUND OF THE INVENTION

This invention relates generally to articles which are sometimes called copy holders, and which are adapted for use with instruments having keyboards--such as typewriters, composers, microcomputers, etc. More specifically, the invention comprises a tool for holding a flexible sheet upon which data appears--in order to assist an operator in manually transferring that data from the sheet into the instrument by use of the keyboard.

It is well known that computers have the capacity to process certain data at a rate which is usually many times faster than the human brain can process that data. And, as the price of small computers continues to drop, so that they are more readily affordable by larger number of people, it is logical to expect that the use of small computers will continue to expand. However, an ordinary microcomputer's potential speed is of no benefit until it has been programmed, i.e., given instructions on what to do, and also given data with which to work. Regrettably, using a keboard to put a program into the memory of a microcomputer can sometimes be both tedious and frustrating--especially when the program is complicated. This is because a typical physical arrangement for using a microcomputer involves placing a monitor (which includes a CRT screen) directly above the keyboard, so that the operator can see what he or she has entered into the microcomputer by virtue of stiking certain keys. This customary spatial relationship between the keyboard and a monitor has made it necessary that a source sheet (from which information is being copied) must be positioned to either the right or the left of the keyboard. If the source sheet contains a series of numerals and/or letters which make no sense in a narrative way, a great deal of concentration is required in order to observe the printed data, press the corresponding keys on the keyboard, and then look at the monitor screen to verify that the correct keys have been pressed. Of course, a proficient computer operator, like a proficient typist, may be able to enter data into a computer without looking at the keyboard; but there is still the requirement for the operator to switch his or her attention back and forth between the monitor screen and the source sheet. This switching of attention not only involves sideward movement of the operator's head, it may also involve continually re-focusing the operator's eyes on the data that is being monitored.

While a way has not been found to avoid the verification process which dictates that the operator switch attention back and forth between two sets of data, there has at least been some effort (with "copy holders") to hold the source sheet at a convenient elevation beside the computer terminal. Such copy holders are similar to devices that have been used by typists for many years--for holding source sheets at a location to foster ease in transferring narrative information from a source sheet into typewritten form. Also, a variety of configurations for desks, stands and tables have been proposed to foster efficiency in the arrangement of such structures as are needed to support computer hardware and any ancillary equipment, etc. But, in spite of all the attention to efficient furniture design, and in spite of the efforts to adapt traditional office equipment so that it meets the needs of modern computer operators, there has still remained a need for a copy holder that is truly compatible with modern microcomputers. Accordingly, it is an object of this invention to provide a copy holder that places a source (or reference) sheet as near as possible to the monitor screen, so that operator eye movement between the source sheet and the monitor screen can be minimized.

Another object is to facilitate the physical management of a long source sheet by permitting at least most of that sheet to rest behind the monitor when it is not being used by the operator for reference purposes.

Still another object is to provide both horizontal and vertical "locator" lines which are easily moveable with respect to the data on a source sheet, to promote the efficient transfer of data and/or proofreading of data that has already been keyed into a computer, etc.

One more object is to provide an accessory for a microcomputer which can eliminate the side-to-side head movements that are commonly involved in manually transferring data from a source sheet to a microcomputer by use of a keyboard.

To meet these and other objects, the invention disclosed herein constitutes an apparatus which is adapted to support a flexible sheet immediately adjacent the screen of a monitor. The apparatus has a relatively wide but short region wherein data which is printed on the flexible sheet can be reviewed so that a great quantity of vertical space is not consumed by the article, and so that full access to operative portions of the hardware (such as a computer keyboard) is not adversely affected. While only a narrow "window" for examining data is provided, a supporting structure extends around a relatively wide passage--such that a long and flexible sheet can be moved through said passage in order to sequentially present different transverse portions of the data sheet within the "window." After an operator has looked through the "window" and examined a given segment of data, that particular segment can be moved out of the way and a fresh segment brought into view. The process is repeated until all of the data has been reviewed on a line-by-line or segment-by-segment basis. The entire data sheet can then be easily removed from the apparatus, leaving it in condition to receive another data sheet if such a sheet is to be copied. If no subsequent sheet is to be immediately copied, the apparatus remains in place for as long as seems to be appropriate, without taking up a significant amount of "working" space.

DESCRIPTION OF THE FIGURES OF THE DRAWING

FIG. 1 is a perspective view of one embodiment of the invention which is characterized by great simplicity--in that the number of moving parts is at essentially a minimum;

FIG. 2 is a side view of a typical microcomputer installation wherein a microcomputer keyboard, floppy disk drive and CRT monitor are oriented vertically, and wherein the apparatus of FIG. 1 has been placed in an optimum position immediately below the monitor;

FIG. 3 is a fragmentary view (partially sectioned) of the frontal portion of the apparatus shown in FIG. 1, and illustrating a typical paper path through the throat of the apparatus;

DETAILED DESCRIPTION OF THE PREFERRED EMBODIMENTS

Figure 4:
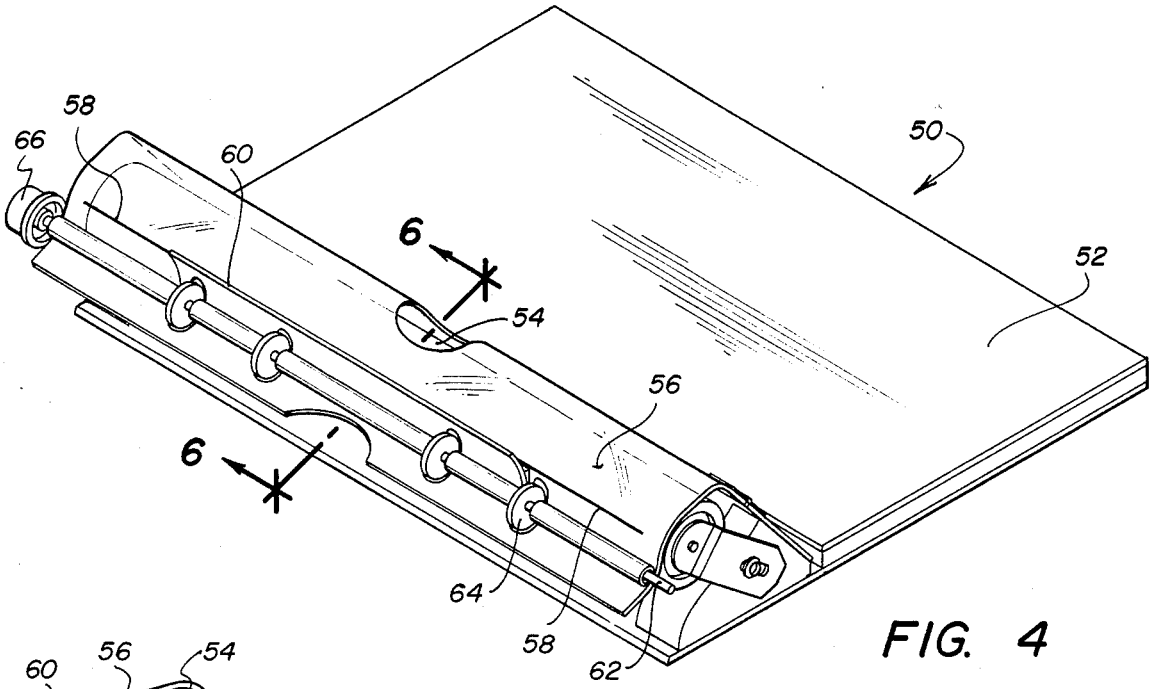
FIG. 4 is a perspective view of another embodiment of the invention, with this embodiment being characterized by having a frontal roller about which paper passes as it is being examined.

Referring initially to FIG. 1, a very fundamental embodiment of the invention has no moving parts, or--at most--one moving part. The device 10 includes a structural housing 12 which has a strength such that it is adapted for supporting a monitor in front of a computer operator. Such monitors typically weigh about 15 or 20 pounds for black-and-white versions; but, some persons are known to use an old color TV as a monitor, which can weigh as much as 50 pounds. Hence, it is advisable that the housing 12 be sufficiently strong as to support a monitor weighing as much as 50 pounds.

The structural housing 12 preferably includes a pair of generally parallel plates 14, 16 arranged one above the other. The upper surface of the top plate 14 is configured to directly receive and support the anticipated monitor. If the monitor is to be tilted (in order to perhaps deal with a problem of reflection off the monitor screen), then the upper surface of plate 14 may advantageously have an irregular or textured surface--so as to preclude the monitor from sliding away from its desired position. The lower plate 16 is typically adapted to rest on a generally horizontal surface--which may be the top of a microcomputer housing, one or more disk drives, a shelf or some other structural element.

The pair of generally parallel plates 14, 16 are separated by a relatively narrow gap, for example, about 1 cm, so that the overall height of the structural housing 12 need not be very great. One reason for wanting the structural means 12 to be relatively thin is to avoid elevating the monitor screen by a substantial amount when the monitor is placed thereon; otherwise the operator could be forced to significantly after his normal line of sight in order to observe what is displayed on the screen. The two plates 14, 16 are held apart by two spaced side members 18, 20, which may be permanently affixed to the two parallel plates. The side members 18, 20 are preferably separated--in a horizontal direction--by a distance of at least 11½ inches, so that a sheet of flexible material (e.g., paper) having a width of as much as 11 inches may pass freely between the pair of spaced plates.

Rigidly attached to the frontal section of the upper plate 14 is a transparent cover 22, which preferably extends for the full distance between side members 18, 20. The length of the transparent portion 22, as measured in a front-to-rear direction, is largely a matter of choice; but it will typically be on the order of 3 or 4 cm, plus any additional length that is present for mounting or other structural reasons. It is this transparent portion 22 that the operator is expected to look through in order to see data that is written on a flexible sheet of material which is positioned between the plates 14, 16. Because an operator will likely be concentrating his or her attention on one transverse line of data at any given time, there is no need to have a particularly long "window" for the operator to look through. Furthermore, an unusually deep window 22 would inevitably begin to conceal some part of the monitor screen or other hardware; hence, a short transparent portion having a length of about 3 cm is usually quite adequate.

Along the forward edge of the transparent portion 22 extends an upwardly turned lip 24, which can perhaps be best seen in FIG. 2. The lip 24 preferably extends for the full length of the housing 12, although there may be an intermediate gap 26 for the purpose of fostering ease in gripping a flexible sheet that is in the device 10. The purpose of this up-turned lip 24 is to provide a physical support for an optical bar 28 which can be moved along the lip in order to magnify or otherwise enhance the readability of data on a sheet of material. That is, when the device 10 is installed so that it is generally horizontal, the lip 24 will also be horizontal, and a magnifying bar 28 resting on said lip will magnify any text which is behind the transparent portion 22.

In another embodiment, the movable optical bar 28 has a scribed mark 30 near the middle of the bar. This mark 30 will lie in a generally vertical plane when the device 10 is positioned horizontally. The function of a narrow, opaque mark 30 is to provide a visual "locator" or focal point--toward which an operator may direct his attention when a complex piece of data is being entered into a computer's memory with the keyboard.

Also visible in FIG. 1 is another aid to help the computer operator focus his attention on a precise element of data which is to be copied; this aid is a relatively long scribed mark 32 along the transparent portion 22 of the frontal section. Such a scribed mark 32 can be particularly useful in identifying a certain one of several, closely spaced lines of data. And, while the transverse segment of data that is visible through the window 22 is relatively narrow, it is nice to be able to pin-point the exact line that is being copied. Periodically re-positioning the flexible sheet S can, of course, put a fresh segment of data into alignment with the scribed mark 32, in the same manner that an earlier segment was aligned.

Another very important element of the device 10 is a support means 40 which is adapted for supporting a flexible sheet of material S in such a way that the material is folded into a generally U-shape adjacent the front of the housing 12. Typically, this support means 40 will itself be near the front of the housing; but, it is the function of this means, rather than its location, that is critical. A frontal section 42 of the support means 40 is positioned behind and below the transparent element 22--but close enough behind said transparent element in order to preclude distortion of any data that is to be copied. In fact, having a gap of about 2 mm between the transparent element 22 and the support means 40 is often about right for most designs. The extent to which the frontal section 42 protrudes toward the front of the device 10 is largely a matter of choice; but it should not be either too far to the front, nor too far to the rear, unless the user is extremely dexterious--as will now be explained.

The function of the support means 40 is to provide a structure about which a flexible sheet S can be bent into a generally U-shape. The data which is to be copied is presumed to be on what will be called the outer surface of this flexible sheet, so the sheet will naturally be inserted into the device 10 in such a way that data faces outwardly and is visible to a computer operator or proofreader, etc. The bottom of the U will be near the front of the device 10, and a transverse portion of the sheet (near the bottom of the U) should be visible immediately behind the transparent element 22. When a given segment of data has been observed and handled by the operator, a fresh segment consisting of one or more lines of data may be exposed by pulling (or pushing) the sheet so as to change its relative position within the apparatus. To facilitate this manual repositioning of a flexible sheet, a finger hole 44 is advantageously provided in the transparent portion 22, behind the viewing region. Such a finger hole 44 can more readily ensure that a small piece of paper or the like will not become captured in such a way that its removal is awkward. Also, indentations in the front edges of the lower plate 16 and transparent portion 22 can also be used to advantage by a computer operator when grabbing, pushing or pulling a sheet of paper that is in the device 10.

Thus far, all of the elements that have been described--and which are contacted by a flexible sheet S--are advantageously made of smooth, rigid materials; as such, they would not normally have any rough surfaces that would introduce any significant friction which would act on the flexible sheet. However, there may be occasions when it would be advantageous to have a drag force which would resist movement of the flexible sheet S. For example, if data is being taken off a very long sheet and the operator has come to almost the end of that sheet, he would not want the accumulated weight of one end of the long sheet to cause the other end to be prematurely pulled past the transparent portion 22. To overcome this potential problem, it is preferred that the support means 40 be shaped so that the flexible sheet follows a non-linear path as it travels through the device 10. The degree to which the flexible sheet is caused to bend, as well as the number of such bends, will naturally affect the degree of drag that is experienced by the flexible sheet. As shown in FIG. 3, a single bend of about 75° has been found to be particularly beneficial, provided that there is a significant distance (i.e., more than one cm) of straight travel on either side of the bend. Those persons who are familiar with bent paper will surely appreciate that the showing of the flexible sheet S in FIG. 3 is in the nature of a theoretical showing; and an actual sheet will naturally be lying against one side or the other of the channel, depending upon the forces that were responsible for producing its location. So, for simplicity in the drawing, the sheet S is shown as being suspended in the channel.

Pulling or pushing on the sheet S re-positions it so that a fresh segment of data is visible to the operator in essentially the same location that an earlier segment of data was visible; so the operator does not have to refocus his eyes on fresh segments that are spaced differently than old segments. And, to assist concentration within a given line of data, the optical bar 28 is particularly useful. The length of the optical bar 28 is preferably less than the length of its support means, so that it may be manually positioned at almost an infinite number of locations along the lip 24--for the purpose of moving the vertical scribed mark 30 to where it is adjacent any desired character in a horizontal line of data. For example, when the support means 24 is about 40 cm wide, the optical bar is advantageously about 15 cm long. By locating the vertical scribed mark 30 in the center of the optical bar 28, the scribed mark can be positioned at a desired location without causing an end of the bar to protrude unreasonably far beyond the boundaries of the housing 12.

Figure 5:
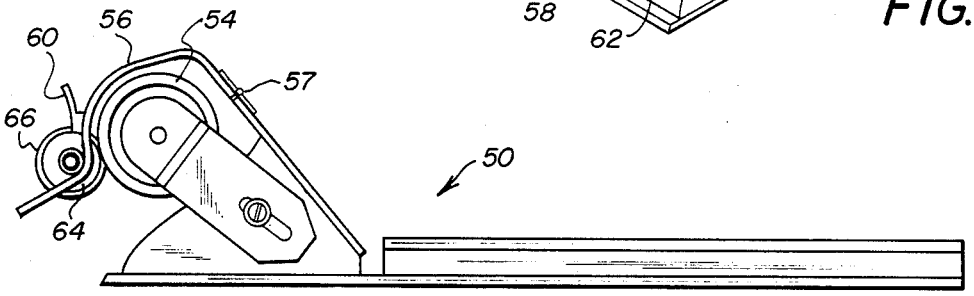
FIG. 5 is a side elevational view of that embodiment of the apparatus that is shown in FIG. 4.
Figure 6:
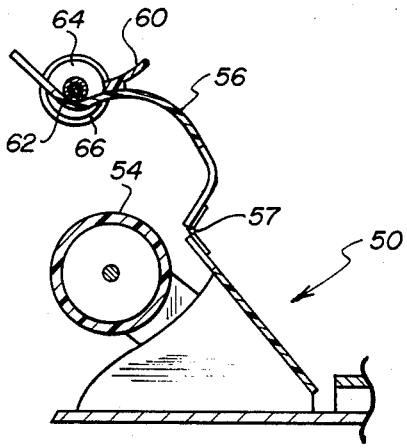
FIG. 6 is a fragmentary showing of the apparatus, similar to the showing in FIG. 5--but illustrating a transparent cover in an elevated position.
Figure 7:
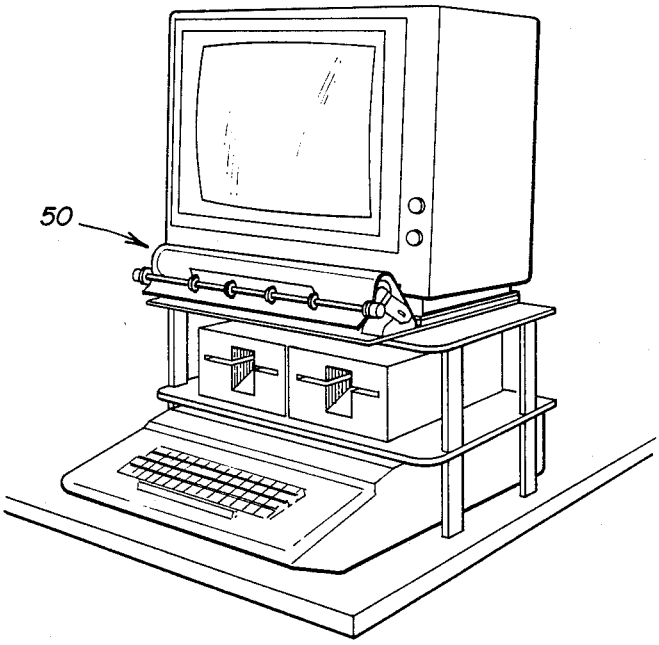
FIG. 7 is a perspective view of an exemplary installation of the embodiment shown in FIG. 4.

Referring next to another embodiment of the invention, the apparatus 50 (shown in FIGS. 4–7) also has a structural means 52 which is adapted for supporting a display device such as a monitor in front of a computer operator. Adjacent the front of said structural housing 52 is a support means in the form of a generally cylindrical element 54; the cylindrical element is positioned with respect to the housing so as to provide ample clearance for a flexible sheet to pass around it and extend through the housing 52 and out the back thereof. The cylindrical element 54 may be designed to remain static, or it may turn (i.e., rotate) about its longitudinal axis. To foster exact alignment of the support element 54 with the housing 52, it ends are preferably adjustable with respect to the base on which the element is mounted, as illustrated in FIGS. 4 and 5. Also clearly shown in these two figures is a transparent cover 56 which is adapted to hold a flexible sheet in a controlled position around the element 54.

In this particular embodiment, the cover 56 has a generally arcuate shape so as to rest closely over the cylindrical element 54 when said cover is in its operative position. As with the earlier embodiment 10, cover 56 may advantageously have a horizontally scribed line 58 which will assist the operator in concentrating his attention on a particular line of horizontally oriented data. And, an up-turned lip 60 is also advatageously provided along at least part of the frontal portion of the cover 56. A magnification element, such as a so-called cylindrical lens (like previously described lens 28), may easily rest in the V-shaped groove formed by the cover 56 and the lip 60. When a vertical line is scribed on the back of such a movable lens, the operator will have both horizontal and vertical index lines at his disposal for temporarily "marking" the source data that he is entering into the computer, one character at a time.

Because of the relatively large size of the cylindrical element 54 and its cover 56, it may be advantageous from time to time to be able to move the cover away from its resting position over the cylindrical element. To this end, the cover 56 is hingedly connected to the housing 52 along a hinge line 57 which extends parallel to the cylindrical element 54 and is preferably behind said cylindrical element. At any time, then, the operator can manually lift the cover 56 away from the cylindrical element 54 so as to foster any manual manipulation of a sheet of paper that seems to be desirable.

The cover 56 preferably has a rather substantial size, such that it completely shields the front of the cylindrical element 54. In order to change the location of the flexible sheet with respect to the housing 52, it is advantageous to provide a bail 62 which is preferably supported by the cover 56. The bail has a plurality of paper-contacting elements 64, such as rubber wheels, that are sized and located so as to bear against a flexible sheet when the cover 56 is in its operative position. A means is also provided for turning the bail, so as to either advance or retract a flexible sheet with respect to the apparatus 50. The simplest technique for rotating the bail 62 constitutes one or more manually operable knobs 66, only one of which is shown in FIGS. 4 and 5 (with the right-hand knob being omitted for clarity). Alternatively, a foot pedal that is accessible to the computer operator could be operationally connected to a drive motor or pulley which, when turned, could rotate the bail and cause the contact elements 64 to push the sheet in a desired direction.

By placing the hinge line 57 for the cover 56 behind the cylindrical element 54, and by placing the bail 62 and its associated driving elements 64 in front of the cylindrical element, the weight of the bail and its support structure is usually enough to furnish a dependable driving force against a flexible sheet when the ball is turned--without the need for any auxiliary springs or the like. That is, a downward force from the inherent weight of the cover 56 and the bail 62, etc., will produce a radially directed component that helps force a flexible sheet through the apparatus 50 when a knob 66 is turned.

To practice the invention, a person skilled in the art would be expected to make a basic decision about whether a copy holder is going to be placed vertically above or below the screen of a display device. And, the particular instrument with which the copy holder is to be used is also advantageously considered. If the instrument is a microcomputer and the display is a conventional monitor with a CRT screen, a person need only verify that there is space above or below the screen to install one of the copy holders. If necessary, the structural housing can be custom shaped to fit an unusual computer housing, keeping in mind that there should be a free and unobstructed passage for a flexible sheet to pass internally through the "throat" of the housing. For most installations, however, the straight and thin housings 12, 52 shown in FIGS. 1 and 4 will be quite satisfactory. To install an apparatus like the one shown in FIG. 1, a person would simply lift a monitor for a short distance above its existing position and insert the housing 12 under the monitor. The flexible sheet having data which is to be entered through the computer keyboard would then be passed through the throat of the housing (between the pair of generally parallel plates) until the beginning segment of data is visible at the front of the apparatus. If appropriate, one or both of the free ends of the sheet would then be turned around and passed backward through the housing so as to form a generally U-shaped fold around the frontal support means. The flexible sheet S would then be adjusted so as to place a particular line of data at a location where it can be easily seen by the computer operator.

As often as seems to be desirable, then, the operator can switch his attention from the source data to the vertically adjacent screen of the monitor. Such eye movement would naturally be minimal, because the source data and the entered data are positioned so close together; and both sets of data lie in a plane that is essentially equidistant from the operator's eyes. Thus, the operator would not have to refocus his eyes as he shifts to and from the source data. When appropriate, the operator can periodically reposition the flexible sheet so that a fresh segment of data is visible to the operator in the same location that an earlier segment of data was visible. Those portions of the flexible sheet that were not being studied would typically be stored behind the housing, by virtue of being temporarily pushed out of the open back of the housing (as indicated in FIG. 2). The re-positioning of the flexible sheet therefore involves the simple task of pulling forwardly on one "leg" of the U and pushing backwardly on the other. And when the data has been entered and checked, or otherwise proofread or compared, the flexible sheet can be removed from the copy holder by simultaneously pulling forward on both "legs" of the U.

While only two preferred embodiments of the invention have been described herein in great detail, it will be appreciated by those skilled in the art that certain modifications of the copy holders described herein can be made without departing from the broad scope of the disclosed concept. For example, the shape of the housing does not necessarily have to be linear, and it can be bent or shaped as necessary in order to mate with a particular computer or other instrument, etc. And the thickness of the housing is also a matter which would permit some variation--although the low profile of the illustrated embodiments is believed to offer the most advantages. Hence, the invention should be understood to be limited only by the scope of the claims which are appended hereto.

What is claimed is:

1. An apparatus adapted to foster the efficient transfer of data into a computer by reducing the necessary eye travel as an operator switches his attention back and forth between a source of data on a flexible sheet and the entered data that is visible on a monitor screen, comprising;

(a) structural means adapted for supporting a monitor in front of a computer operator such that an operator may visually examine data that appears on a monitor screen after the data has been entered into a memory associated with the computer, and said structural means having a frontal opening through which a flexible sheet of material may be pulled toward the operator, and further including a pair of generally parallel plates arranged one above the other, and the upper plate being configured to receive and support said monitor, and the lower plate being adapted to rest on a generally horizontal surface; and (b) support means for supporting a flexible sheet of material so that the material is folded into a generally U-shape adjacent the front of the structural means, and there being a frontal section of the support means about which the flexible sheet can be wrapped so as to expose to view a transverse portion of the flexible sheet near the bottom of the U, whereby data written on the flexible sheet may be periodically viewed by the operator as said sheet is progressively pulled through the support means and around the frontal section.

2. The apparatus as claimed in claim 1 wherein the pair of generally parallel plates are separated by a gap about 1 centimeter.

3. The apparatus as claimed in claim 1 wherein the pair of generally parallel plates are held apart by spaced side members, and wherein said side members are separated by a distance of at least 30 centimeters, whereby a flexible sheet of material having a width of nearly 30 centimeters may pass freely between the pair of spaced plates.

4. The apparatus as claimed in claim 1 and further including a transparent cover which lies over a frontal section of the support means, whereby an operator may look through said transparent cover in order to see data that is written on the flexible sheet of material.

5. The apparatus as claimed in claim 4 and further including an upwardly turned lip which extends along the forward edge of said transparent cover, and also including a movable optical bar which has a configuration that permits it to be supported by said lip when the apparatus is positioned for use.

6. The apparatus as claimed in claim 5 wherin said optical bar has a scribed mark which lies in a generally vertical plane when the apparatus is oriented horizontally.

7. The apparatus as claimed in claim 6 wherein the length of the optical bar is significantly less than the length of said support means, whereby the optical bar may be positioned at will along the lip on the transparent cover, and whereby the vertical scribed mark may be positioned at a desired location adjacent a particular character in a horizontal line of data.

8. The apparatus as claimed in claim 4 and further including a relatively long scribed mark which extends transversely along the transparent cover, whereby the flexible sheet may be vertically positioned with respect to said scribed line in order to assist visual identification of a certain line of data on said flexible sheet.

9. The apparatus as claimed in claim 4 wherein the transparent cover is hingedly connected to the structural means, such that the transparent cover may be rotated away from an operating position over the support means to a position which more readily fosters the manual manipulation of a flexible sheet within the apparatus.

10. The apparatus as claimed in claim 9 and further including a bail carried by said transparent cover, and said bail having paper-contacting elements which are sized and located so as to bear against a flexible sheet when the transparent cover is in its operative position, and also including means for selectively turning the bail so as to cause a flexible sheet in the apparatus to change its position.

11. The apparatus as claimed in claim 10 wherein said means for turning the bail constitutes a manually operable knob.

12. The apparatus as claimed in claim 1 wherein said support means constitutes a generally cylindrical element.

13. The apparatus as claimed in claim 12 wherein said generally cylindrical element is rotatable about its longitudinal axis.

14. The apparatus as claimed in claim 1 wherein said support means includes a non-planar channel through which a flexible sheet passes as it is progressively pulled through the structural means, and said non-planar channel being sufficiently irregular as to impose a drag force on the flexible sheet when said sheet is pulled through the channel.

* * * * *